US007438568B2

(12) United States Patent
Nishide et al.

(10) Patent No.: US 7,438,568 B2
(45) Date of Patent: Oct. 21, 2008

(54) DIVIDED CONNECTOR

(75) Inventors: Satoru Nishide, Yokkaichi (JP); Yuuichi Nankou, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/489,002

(22) Filed: Jul. 19, 2006

(65) Prior Publication Data

US 2007/0020979 A1 Jan. 25, 2007

(30) Foreign Application Priority Data

Jul. 19, 2005 (JP) ..... 2005-208659

(51) Int. Cl.
*H01R 13/62* (2006.01)

(52) U.S. Cl. ..... 439/157

(58) Field of Classification Search ..... 439/157, 439/540.1, 544, 686, 701
See application file for complete search history.

(56) References Cited

U.S. PATENT DOCUMENTS 5,569,040 A 10/1996 Sumida
6,332,788 B1 * 12/2001 Okabe et al. ..... 439/157
6,352,447 B1 * 3/2002 Ruth ..... 439/540.1
6,666,715 B2 12/2003 Fujita et al.
6,666,728 B2 12/2003 Tachi et al.
7,066,771 B2 * 6/2006 Clark et al. ..... 439/676
2002/0106942 A1 8/2002 Sakurai et al.
2002/0151202 A1 10/2002 Tachi et al.

FOREIGN PATENT DOCUMENTS

GB 1 346 236 2/1974

* cited by examiner

*Primary Examiner*—Jean F Duverne
(74) *Attorney, Agent, or Firm*—Gerald E. Hespos; Anthony J. Casella

(57) ABSTRACT

A frame (10) is provided with accommodating chambers (13) capable of accommodating auxiliary housings (20). A small housing (30) and a supplementary housing (40) also are provided. The housings (30, 40) are united by engaging a dovetail groove (33) and a dovetail projection (43) to form a united housing (50) that has an outer configuration common to the auxiliary housings (20). The auxiliary housing (20) and the united housing (50) can be selectively accommodated into the same accommodating chamber (13) of the frame (10). It is sufficient to prepare a single frame (10) regardless of whether the small housing (30) is used for a specific circuit. Thus, different arrangements can be dealt with inexpensively and efficiently.

18 Claims, 12 Drawing Sheets

DIVIDED CONNECTOR

BACKGROUND OF THE INVENTION

1. Field of the Invention

The invention relates to a divided connector with auxiliary housings accommodated in a frame.

2. Description of the Related Art

U.S. Pat. No. 5,569,040 discloses a divided connector that can be connected with a mating connector. The divided connector has a frame formed with accommodating chambers. Auxiliary housings are accommodated in the accommodating chambers and terminal fittings are mounted in the auxiliary housings. The terminal fittings may be grouped, for example, according to their connector circuits and may be collected in common auxiliary housings for convenient testing, and the like.

Production processes for harnesses of important circuits, such as air-bag circuits, are different from the production processes for harnesses of general circuits. On the other hand, important circuits often have fewer contact positions. Thus, the use of auxiliary housings for general circuits is wasteful because many cavities are left empty. Nevertheless, if exclusive auxiliary housings are prepared, a frame must have accommodating chambers used exclusively for the auxiliary housings. Thus, it is necessary to produce a frame having a different construction, leading to a considerable cost increase.

The present invention was developed in view of the above problem and an object thereof is to improve the flexibility of a divided connector.

SUMMARY OF THE INVENTION

The invention is directed to a divided connector for connection with a mating connector. The divided connector has a frame formed with accommodating chambers. Auxiliary housings are provided for accommodation in the accommodating chambers and terminal fittings are mounted in the auxiliary housings. The divided connector further has at least one small housing that is smaller than at least one of the accommodating chambers and at least one supplementary housing that can be united substantially side by side with the small housing. The united assembly of the small housing and the supplementary housing has an outer configuration substantially corresponding to at least one of the auxiliary housings.

The small housing and the supplementary housing may be connected with harnesses of different circuits. This united housing may be accommodated in one of the accommodating chambers of the frame in place of one of the auxiliary housings. The united housing has substantially the same outer configuration as the auxiliary housing, and hence can be accommodated precisely in the accommodating chamber. The auxiliary housing can be accommodated in the specified accommodating chamber if the small housing is not needed.

One frame is made regardless of whether the small housing is used. Therefore, different arrangements and different numbers of contact positions can be dealt with inexpensively and efficiently thereby improving flexibility.

At least one groove and at least one mating projection may be formed on connection surfaces of the small housing and the supplementary housing for uniting the small housing and the supplementary housing. The groove and the projection preferably have complementary dovetail shapes. Additionally, the groove and the mating projection preferably extend at an angle to a connecting direction with the mating direction and/or to an insertion direction of the united assembly into the frame. Thus, the small housing and the supplementary housing can be united without being displaced in the connecting direction with the mating connector.

The small housing and the supplementary housing may be latched by latching means. The latching means may comprise at least one latch engageable with at least one projection a lateral edge of the groove.

The auxiliary housing and the united assembly may have at least one stopper plate that contacts at least one contact surface on the frame to stop a pushing operation.

The auxiliary housing and/or the united assembly may comprise at least one elevated surface that comprises at least one resilient holding piece that engages the frame to hold the auxiliary housing and/or the united assembly in a proper mounting position. The resilient holding pieces preferably can be deformed resiliently away from the elevated surfaces and can be pressed against the corresponding surfaces of the accommodating chamber, thereby preventing shaking movements of the auxiliary housing and/or united assembly.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 5:
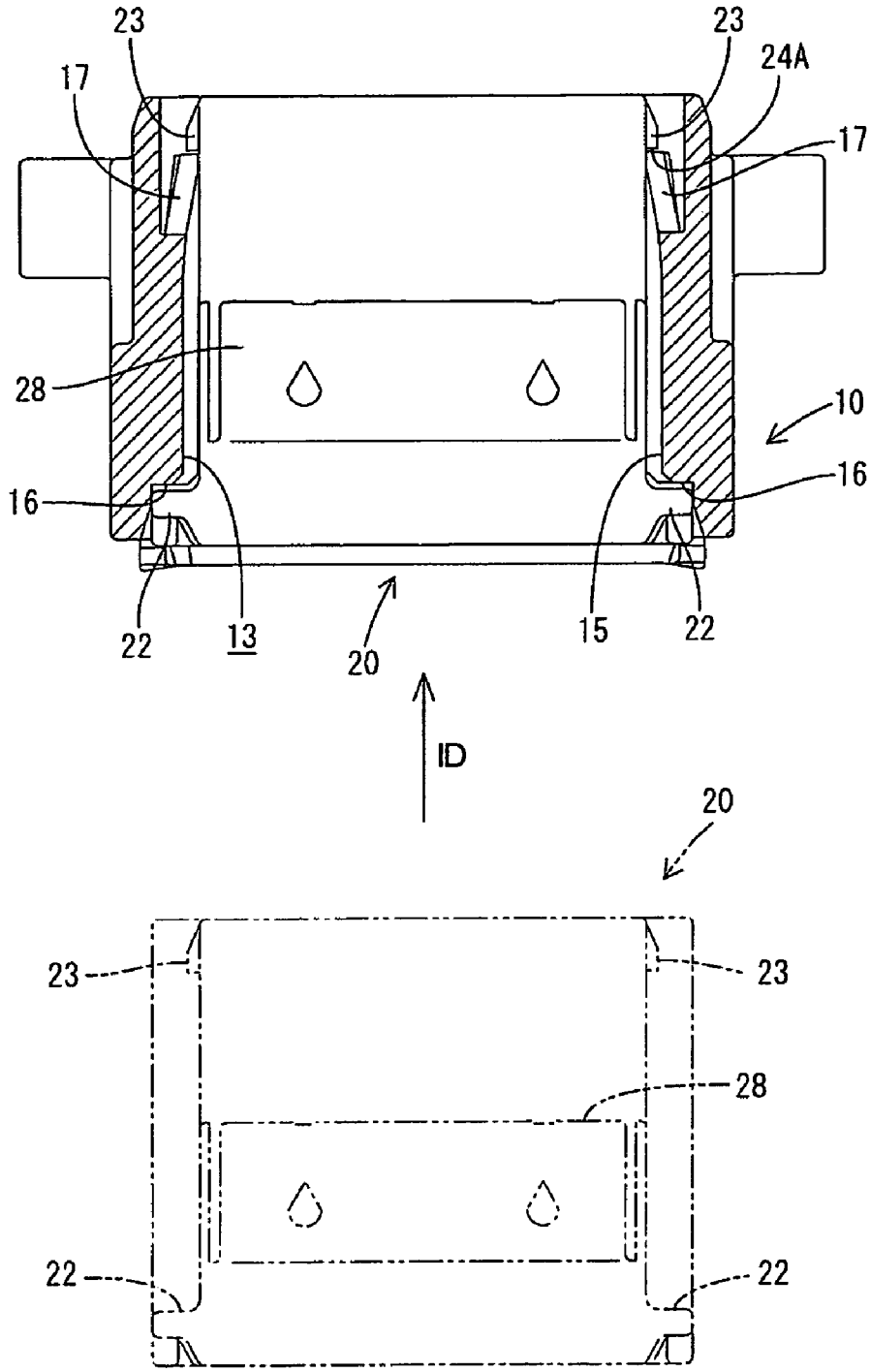
FIG. 5 is a diagram showing an operation of accommodating the auxiliary housing.
Figure 6:
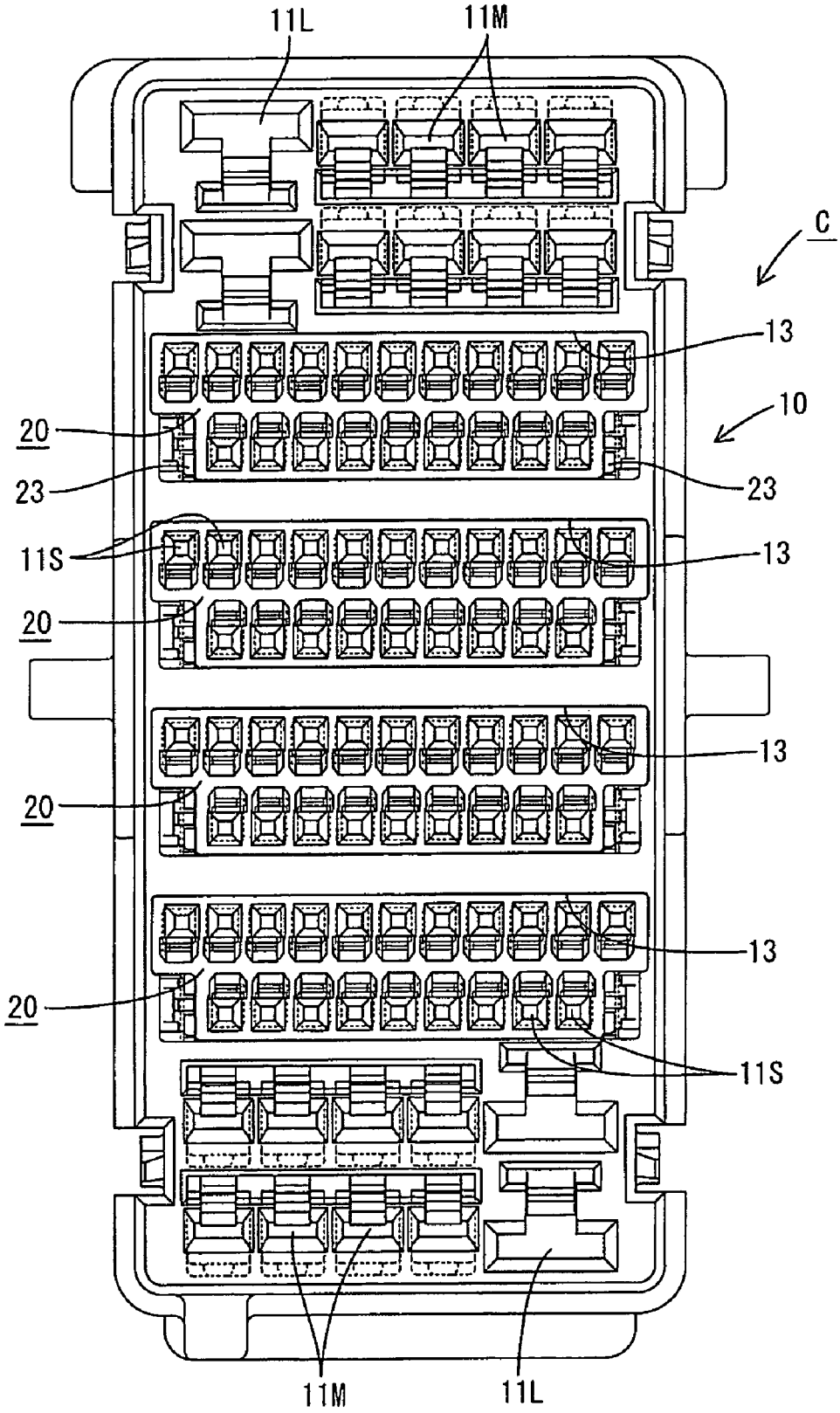
FIG. 6 is a front view of a divided connector accommodating only auxiliary housings.

A divided hybrid female connector according to the invention is identified by the letter C in FIGS. 1 to 13. The connector C can be connected with an unillustrated mating male connector by means of an assisting force of a lever. In the following description, the surface of the divided connector C to be connected with the mating connector is shown in the planes of FIGS. 6 and 13 and is referred to as the front herein.

The divided connector C is provided with a frame 10 made e.g. of a synthetic resin. Large cavities 11L and mid-size cavities 11M in each of upper and lower end areas of the frame 10. The cavities 11L, 11M penetrate the frame 10 in forward and backward directions and are substantially point-symmetrically arranged at both sides. Large female terminals (not shown) are inserted from behind into the large cavities 11L and are locked therein by locks 12L. Mid-size female terminals (not shown) similarly are inserted from behind into the mid-size cavities 11M and are locked therein by locks 12M.

Four substantially identical accommodating chambers 13 are formed one above another in a vertically intermediate part of the frame 10 and penetrate the frame 10 in forward and backward directions. Auxiliary housings 20 are insertable into the respective accommodating chambers 13 from behind and along an inserting direction ID.

Figure 1:
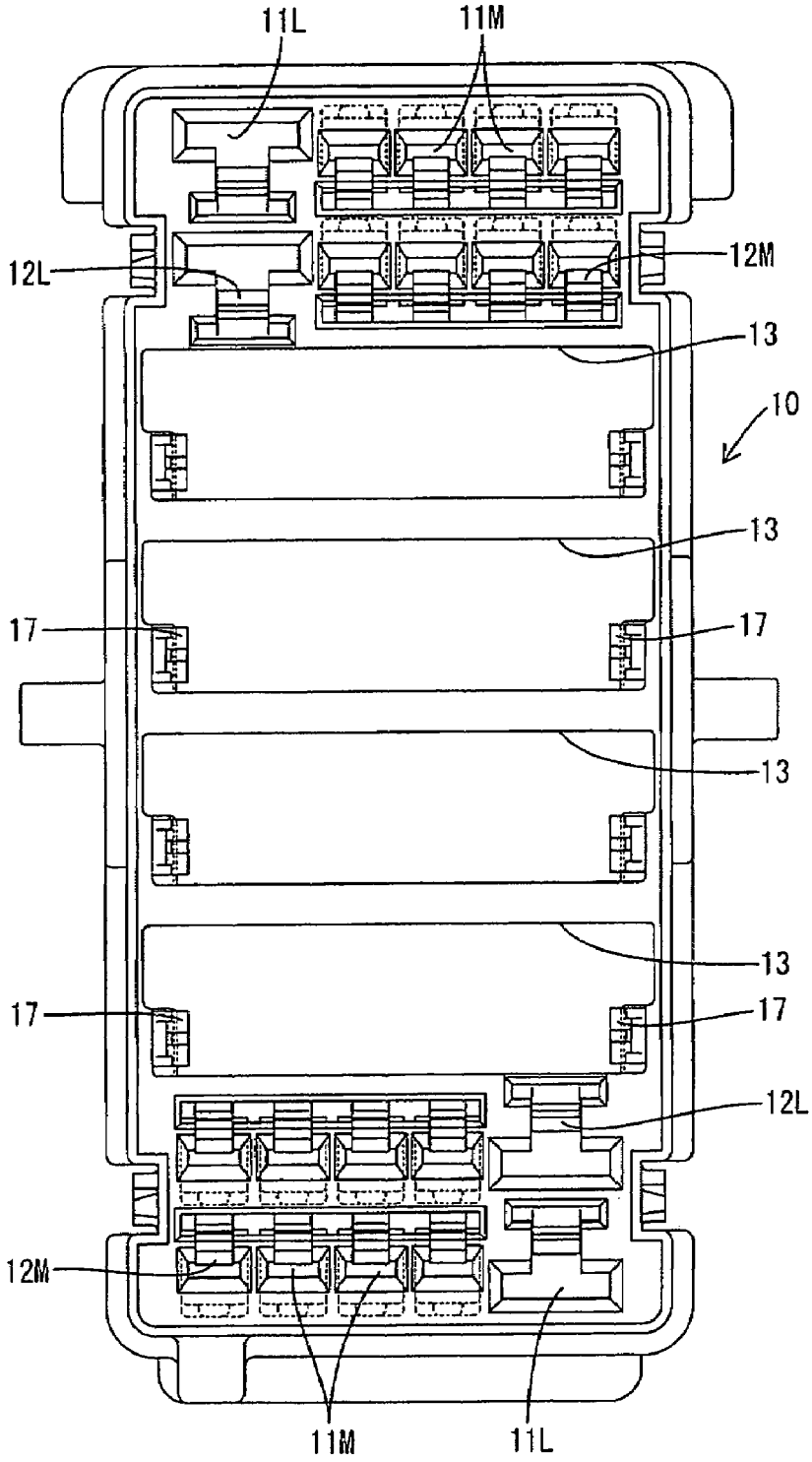
FIG. 1 is a front view of a frame according to the invention.
Figure 2:
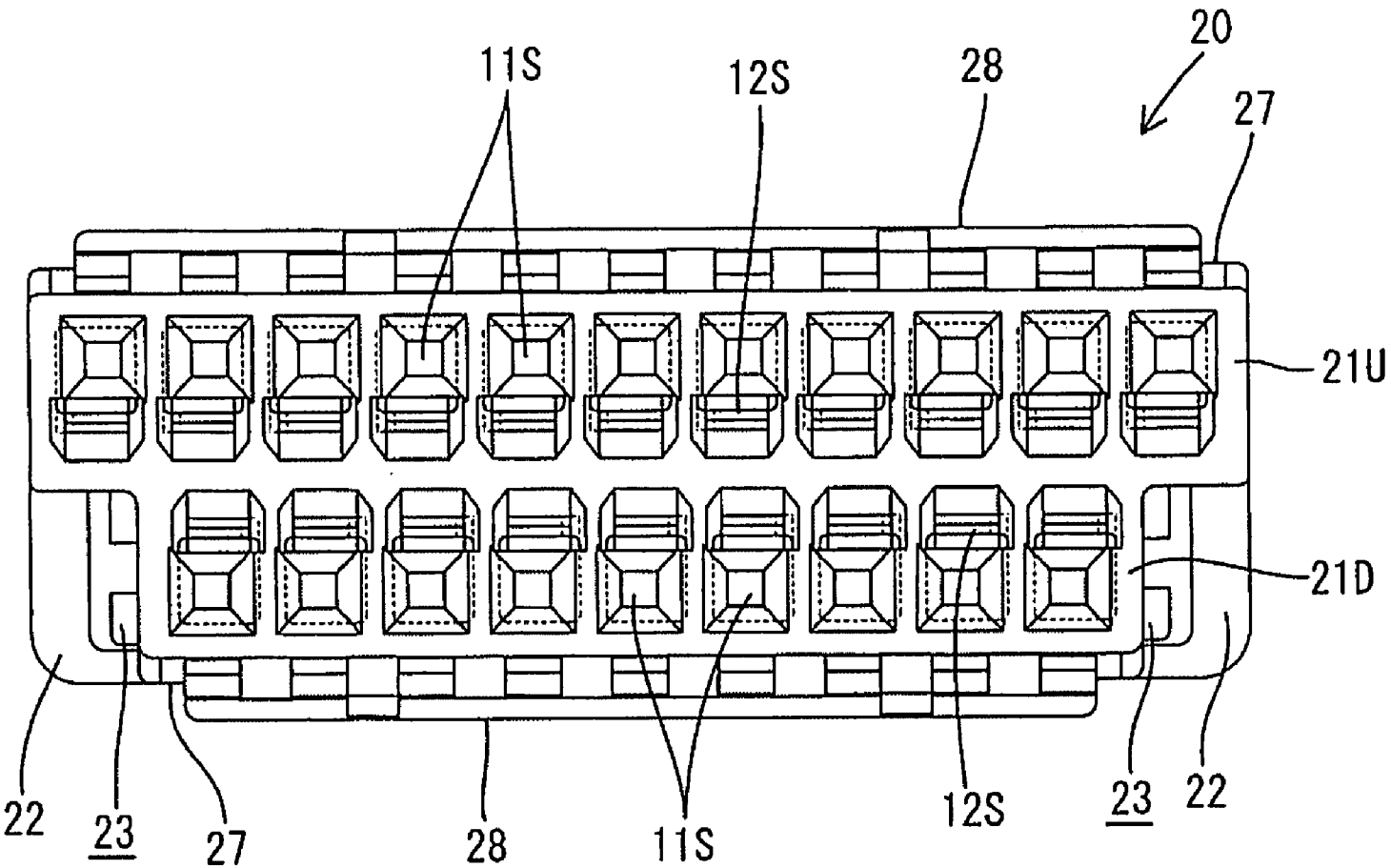
FIG. 2 is a front view of an auxiliary housing.
Figure 3:
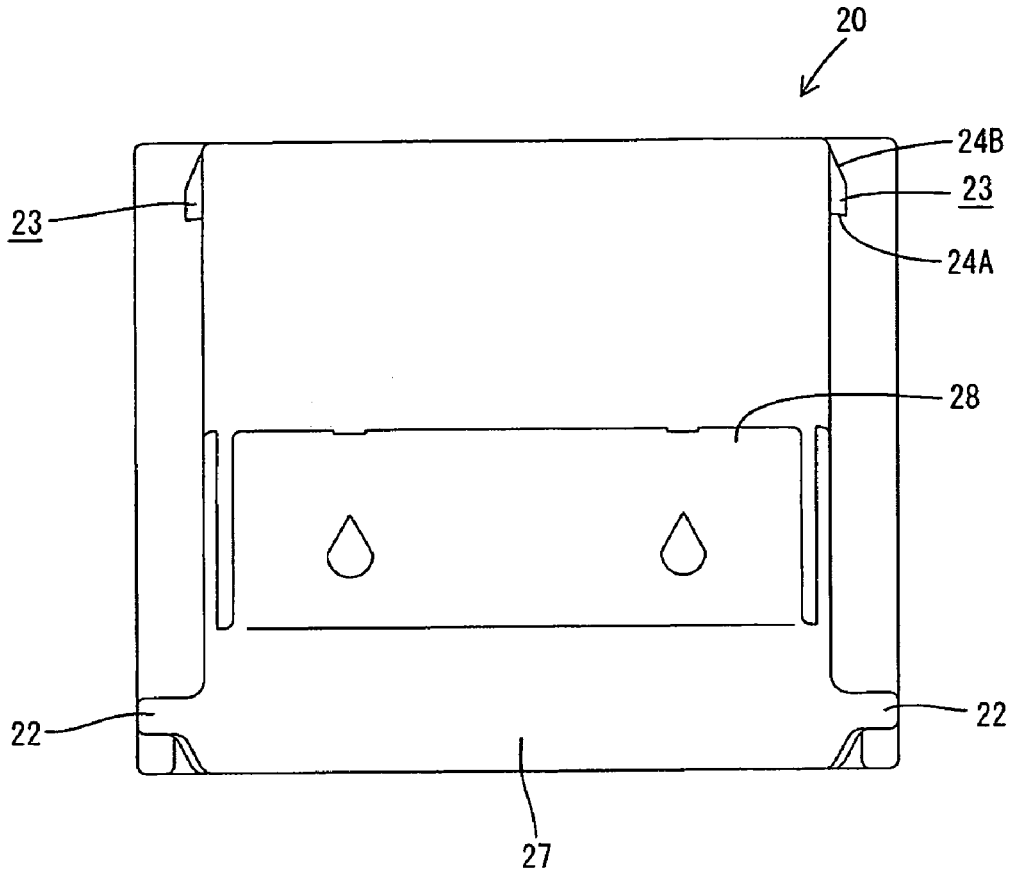
FIG. 3 is a bottom of the auxiliary housing.
Figure 4:
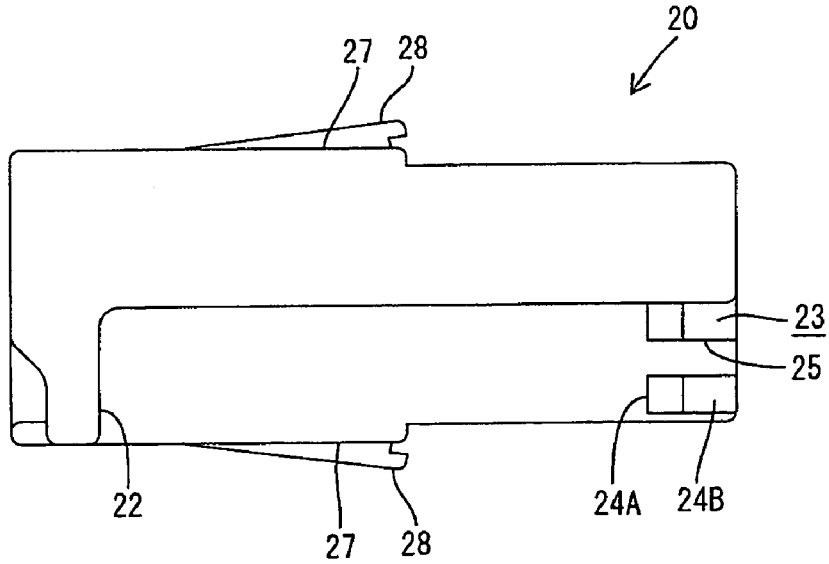
FIG. 4 is a side view of the auxiliary housing.

As shown in FIGS. 2 to 4, each auxiliary housing 20 is a substantially wide block that is stepped so that the bottom is narrower than the top. Small cavities 11S are formed at upper and lower stages 21U and 21D in the auxiliary housing 20 and penetrate the auxiliary housing 20 in substantially forward and backward directions. The small cavities 11S at the upper stage 21U are in a back-to-back arrangement relative to those at the lower stage 21D. Small female terminals (not shown) are insertable into the respective small-size cavities 11S from behind and are locked therein by locks 12S.

Stopper plates 22 bulge out from the opposite left and right surfaces of the narrower lower stage 21D of each auxiliary housing 20 at positions slightly forward of the rear edge. On the other hand, locking projections 23 are formed at the front end. A locking surface 24A is formed at the rear of each locking projection 23 and is aligned at an angle substantially perpendicular to the corresponding side surface, whereas a slanted guiding surface 24B is formed at the front of each locking projection 23. A groove 25 is formed in the widthwise intermediate position of each locking projection 23.

Elevated surfaces 27 are raised slightly at rear portions of the top and bottom surfaces of each auxiliary housing 20 and a resilient holding piece 28 is formed on each elevated surface 27. Each resilient holding piece 28 is slightly narrower than the elevated surface 27. Additionally, each resilient holding piece 28 is open at the leading end and is resiliently displaceable in a direction to become substantially flush with the elevated surface 27.

Each accommodating chamber 13 of the frame 10 has a stepped configuration with a narrow portion 15 at a lower side and a wide portion at the upper side, substantially in conformity with the front shape of the auxiliary housing 20. As shown in FIG. 5, the opposite left and right surfaces of the narrow portion 15 at the lower side are cut at the rear ends (bottom in FIG. 5) to form contact surfaces 16 for contacting the stopper plates 22 of the auxiliary housing 20. Further, two forwardly cantilevered locking pieces 17 are formed at the front ends of the side surfaces and are resiliently engageable with the locking projections 23 of the auxiliary housing 20. The locking pieces 17 are normally in inclined postures with their leading ends facing in.

The auxiliary housings 20 can be inserted into the accommodating chambers 13 from behind and along the inserting direction ID, as shown in FIG. 5. Thus, the upper and lower resilient holding pieces 28 are pressed from opposite sides to be closed and to become substantially flush with the elevated surfaces 27. The auxiliary housing 20 then is pushed so that the locking projections 23 press and resiliently deform the corresponding locking pieces 17. When the auxiliary housing 20 is pushed by a specified amount, the stopper plates 22 contact the contact surfaces 16 to stop a pushing operation. At this time, the locking projections 23 pass the locking pieces 17, and the locking pieces 17 restore resiliently to engage the locking surfaces 24A of the locking projections 23. As a result, the auxiliary housing 20 is accommodated and retained in the accommodating chamber 13.

The front surface of the auxiliary housing 20 is substantially flush with the front of the accommodating chamber 13 and the rear surface of the auxiliary housing 20 projects slightly from the rear of the accommodating chamber 13. Further, the resilient holding pieces 28 on the top and bottom surfaces are deformed away from the elevated surfaces 27 and are pressed against the ceiling and bottom surfaces of the accommodating chamber 13 to prevent vertical shaking movements of the auxiliary housing 20.

Figure 7:
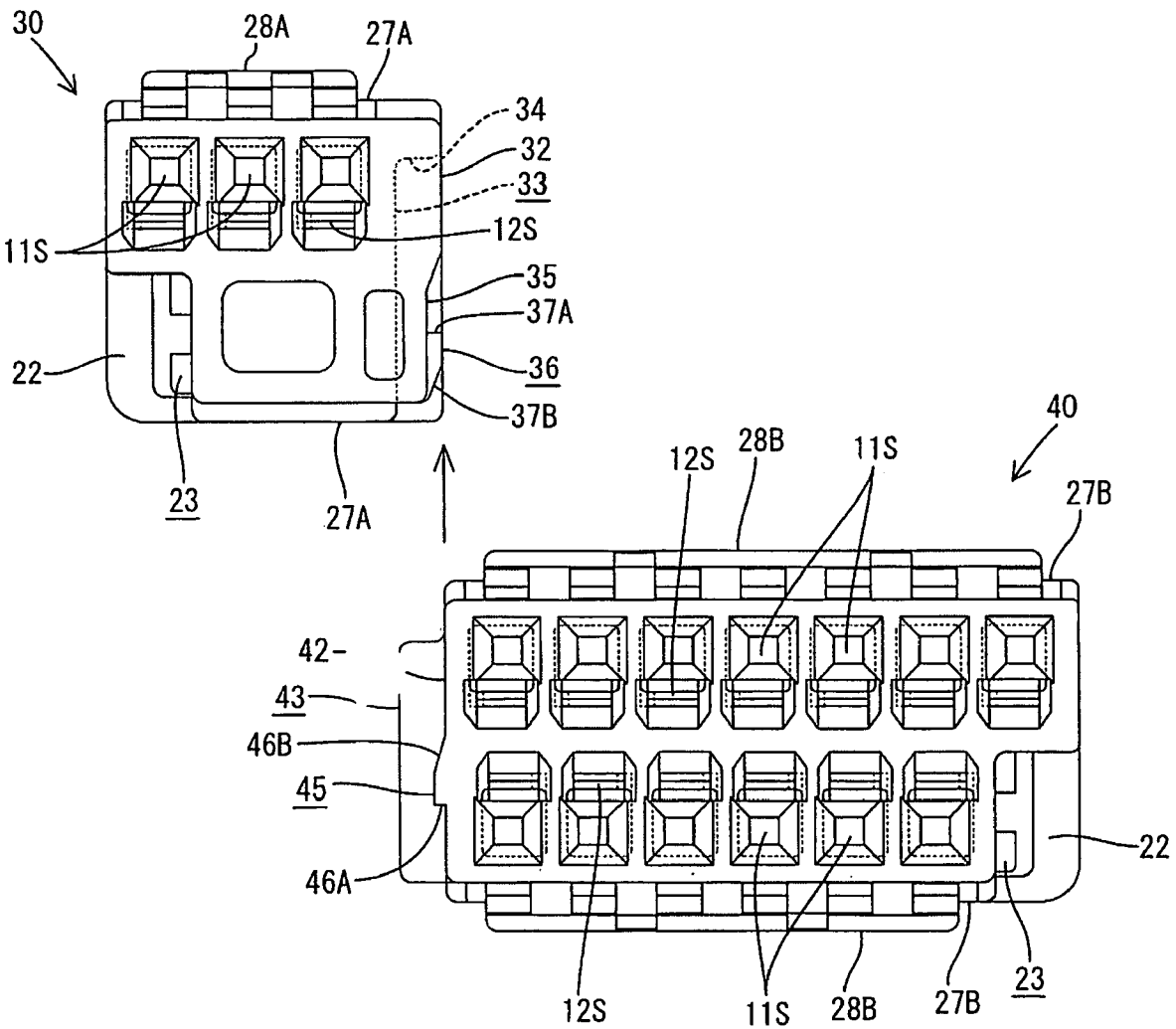
FIG. 7 is a front view showing a state before a small-size housing and a supplementary housing are connected.
Figure 8:
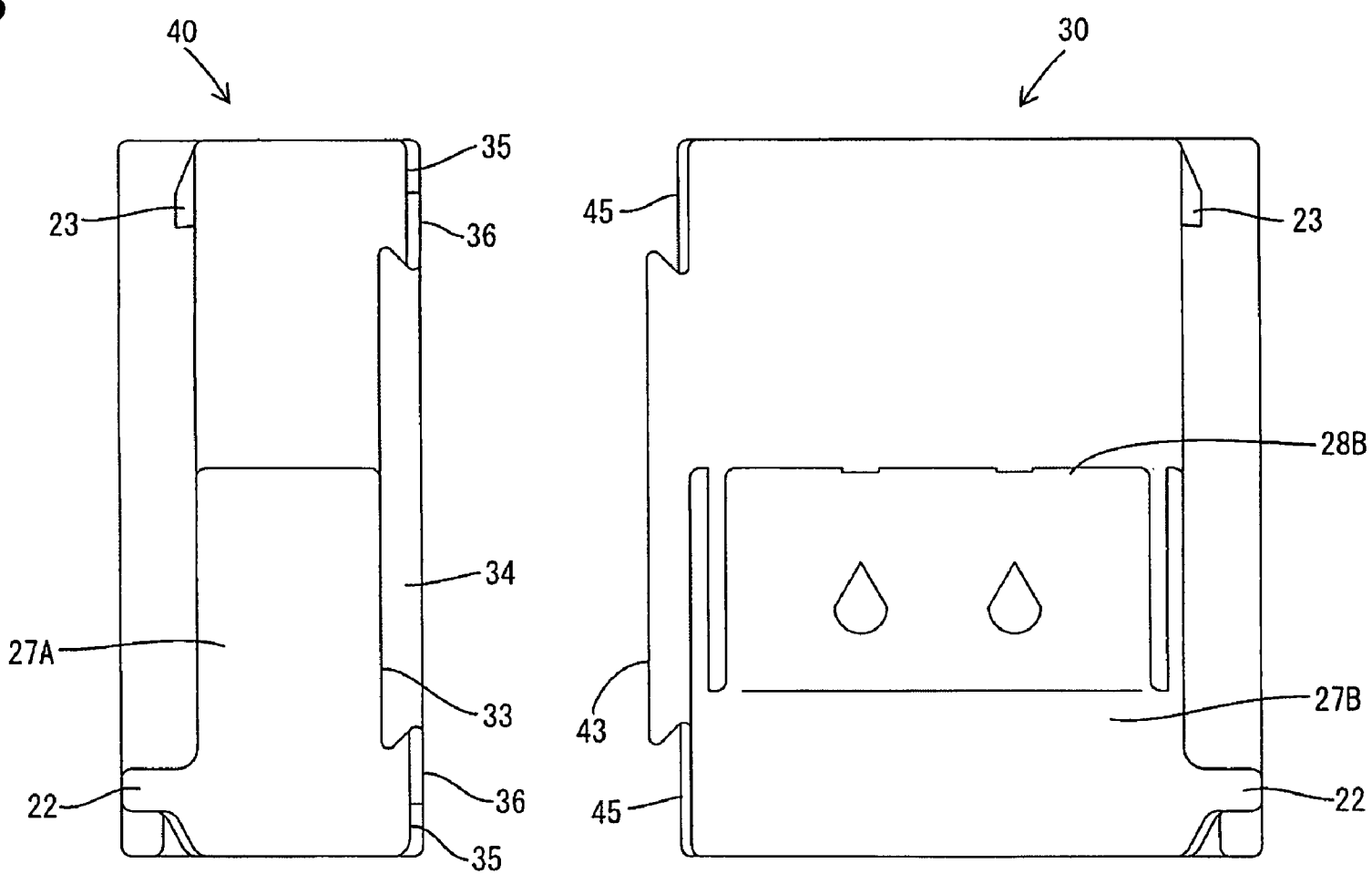
FIG. 8 is a bottom view showing the state before the small-size housing and the supplementary housing are connected.
Figure 9:
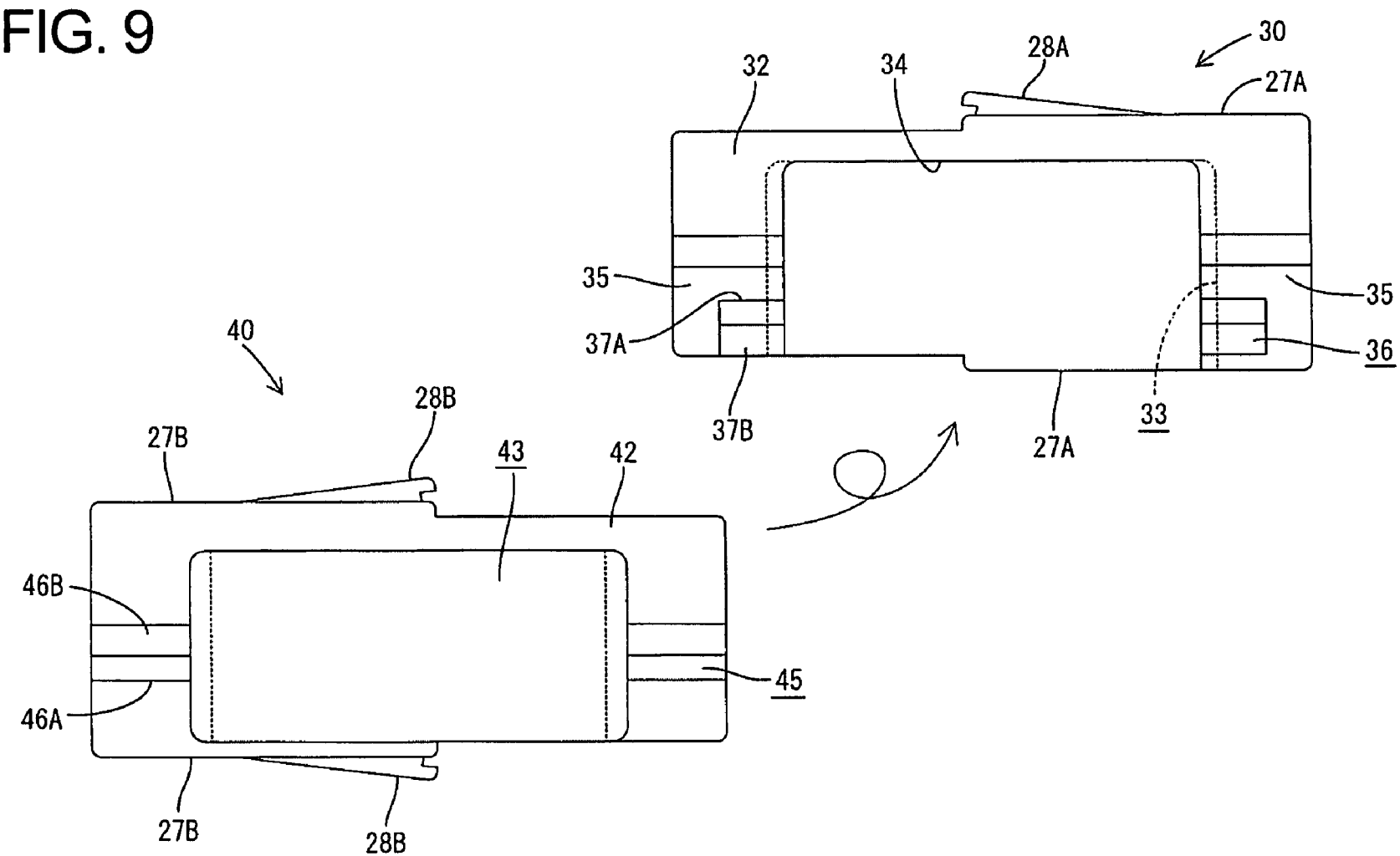
FIG. 9 is a side view showing connection surfaces of the small-size housing and the supplementary housing.

The divided connector further has a small housing 30 and a supplementary housing 40. The small housing 30 has a smaller number of contact positions and is used for a specific circuit, such as an air-bag circuit. The supplementary housing 40 can be united with the small housing 30, as shown in FIGS. 7 to 9. As described later, an assembly of the small housing 30 and the supplementary housing 40 has an outer configuration common to the auxiliary housings 20.

The small housing 30 has a shape substantially corresponding preferably to less than about half of the auxiliary housing 20 at the left side when viewed from front. More specifically, the front shape of the small housing 30 is substantially square, and a cut is made in the left surface of a lower stage to narrow the lower stage.

Three small cavities 11S are formed at an upper stage of the small housing 30 and penetrate the small housing 30 in forward and backward directions. Small female terminals (not shown) connected with a harness of the specific circuit are inserted into the respective small cavities 11S from behind and are locked therein by locks 12S. A stopper plate 22 bulges out near the rear end of the left surface at the lower stage and a locking projection 23 is formed near the front end, similar to the auxiliary housing 20. Elevated surfaces 27A are formed on the top and bottom surfaces, and a resilient holding piece 28A is provided only on the upper elevated surface 27A.

The supplementary housing 40 has a shape corresponding to more than about half of the auxiliary housing 20. More specifically, the supplementary housing 40 has a wide rectangular front shape, and a cut is made in the right surface of a lower stage to narrow the lower stage.

Small cavities 11S are formed at upper and lower stages in the supplementary housing 40 and penetrate the supplementary housing 40 in forward and backward directions. The small cavities 11S at the upper stage are in a back-to-back arrangement with those at the lower stage. Small female terminals (not shown) are inserted into the respective small-size cavities 11S from behind and locked therein by locks 12S.

A stopper plate 22 bulges out at the rear end of the cut right surface of the lower stage and a locking projection 23 is formed at the front end. Elevated surfaces 27B are formed on the top and bottom surfaces, and resilient holding pieces 28B are provided on the upper and lower elevated surface 27B.

A connection surface 32 is defined at the right of the small housing 30 and a dovetail groove 33 is formed in an intermediate part of the connection surface 32 along the vertical direction. The dovetail groove 33 extends substantially normal to the insertion direction ID of the frame 10 and has a cross section that gradually widens from the opening edge towards the bottom. Additionally, the dovetail groove 33 is wider than about half the length and preferably slightly shorter than ¾ of the length of the supplementary housing 40 while extending from the bottom surface of the supplementary housing 40 to a position slightly below the top surface of the supplementary housing 40, as shown in FIG. 9. Accordingly, the dovetail groove 33 has an opening bottom end while having a closed upper end that defines a contact surface 34.

A connection surface 42 is formed on the left surface of the supplementary housing 40 for connection with the small housing 30. A dovetail projection 43 extends vertically along the connection surface 42 and substantially normal to the insertion direction ID of the housings 30, 40 into the frame 10 in a longitudinal middle part. The cross-sectional configuration of the dovetail projection 43 matches the dovetail groove 33.

Engaging projections 45 are formed on the connection surface 42 of the supplementary housing 40 at the opposite front and rear sides of the dovetail projection 43. The engaging projections 45 extend substantially horizontally from the lateral edges of the dovetail projection 43 to the front or rear surface of the supplementary housing 40 at a position slightly below the middle of the supplementary housing 40 with respect to the height direction. As shown in FIG. 7, a locking surface 46A is formed on the lower surface of each engaging projection 45 and is perpendicular to the connection surface 42, and a slanted guiding surface 46B is defined on an upper surface thereof.

Recesses 35 are formed in the connection surface 32 of the small housing 30 at the opposite front and rear sides of the dovetail groove 33 for permitting the entry of the engaging projections 45. Latches 36 are formed at positions near the lateral edges of the dovetail groove 33 at lower sides of the recessed surfaces 35 and are engageable with the engaging projections 45. A locking surface 37A on the top of each latch 36 is substantially perpendicular to the recessed surface 35, and a slanted guiding surface 37B on the bottom of each latch 36.

Figure 10:
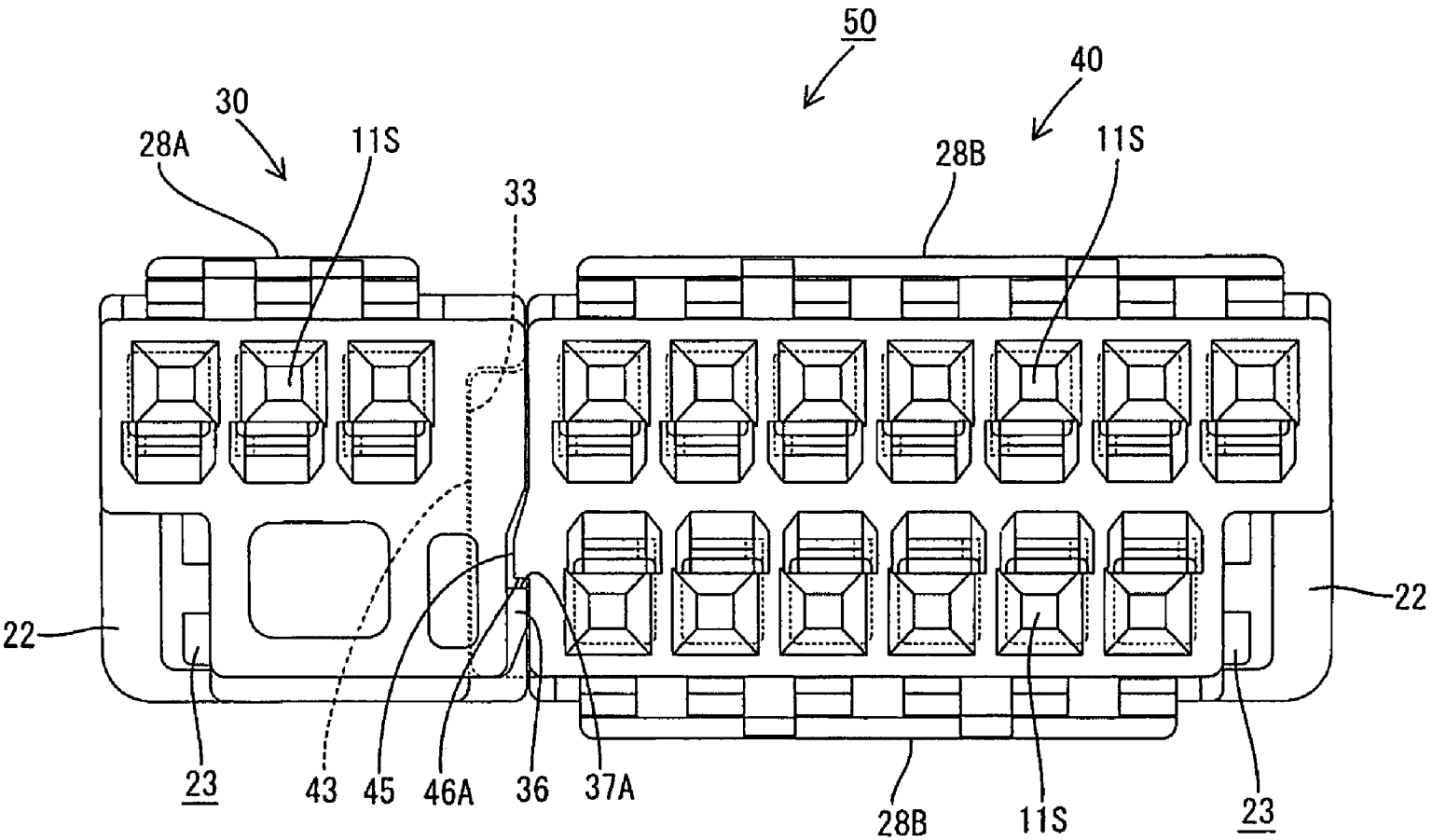
FIG. 10 is a front view of a united housing.
Figure 11:
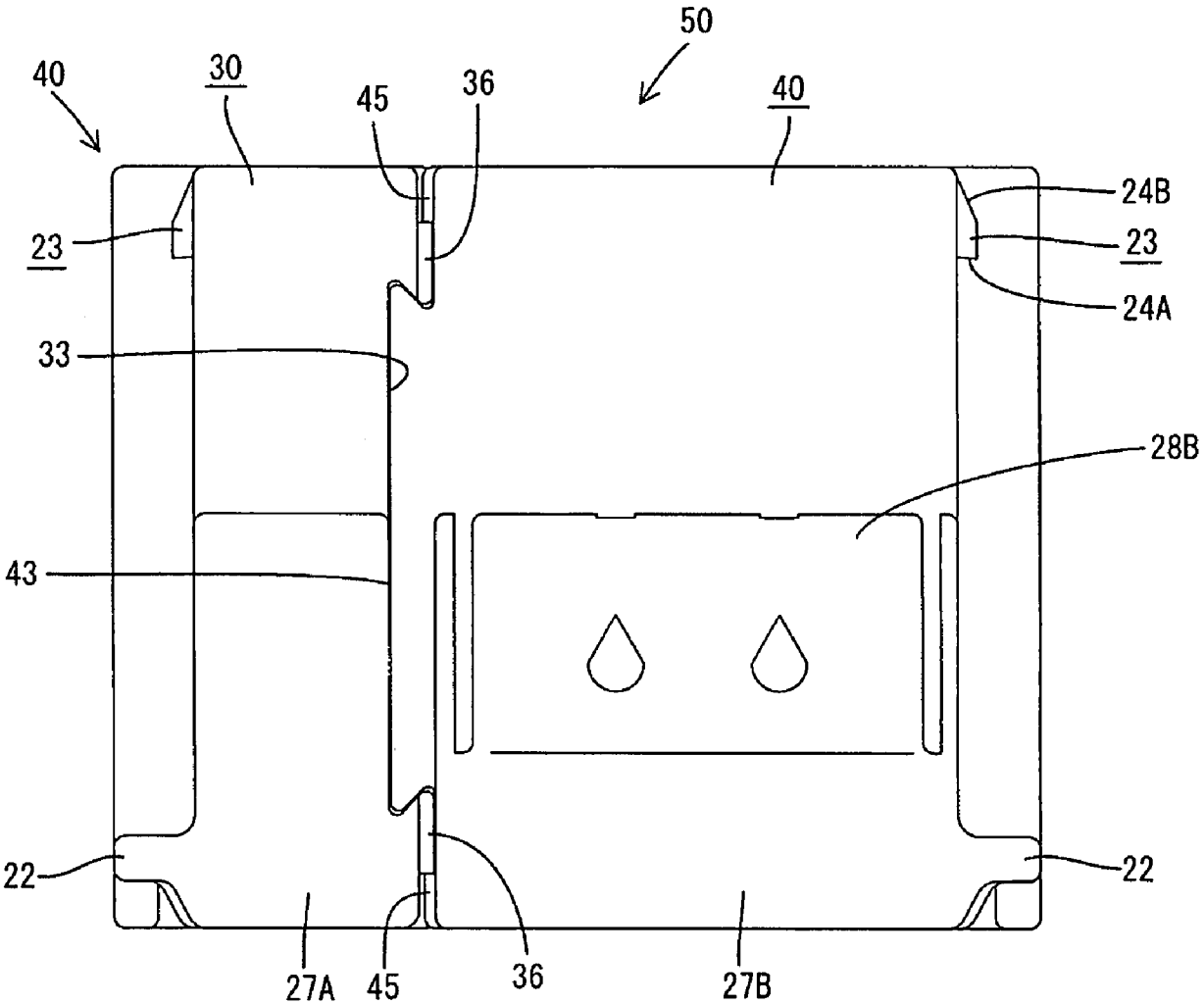
FIG. 11 is a bottom view of the united housing.

The connection surfaces 32, 42 of the small housing 30 and the supplementary housing 40 initially are opposed to each other (e.g. the supplementary housing 40 is reversed with respect to a direction normal to the plane of FIG. 9). The dovetail projection 43 of the supplementary housing 40 then is fit along a mating direction MD into the dovetail groove 33 of the small housing 30 through a bottom opening and is pushed up as shown by an arrow in FIG. 7. The mating direction MD is substantially normal to the insertion direction ID of the housings 30, 40 into the frame 10. This pushing operation is stopped when the upper surface of the dovetail projection 43 contacts the contact surface 34 of the dovetail groove 33. At this time, as shown in FIG. 10, the engaging projections 45 of the supplementary housing 40 move over the latches 36 of the small housing 30 to lock with the locking surfaces 46A, 37A. Thus, the small housing 30 and the supplementary housing 40 are united to form a united housing 50 as shown in FIGS. 10 and 11.

The outer configuration of the united housing 50 substantially corresponds to the auxiliary housings 20. Specifically, the resilient holding pieces 28A, 28B have different shapes, but the outer configuration having to do with the accommodation into the accommodating chamber 13 of the frame 10 is substantially identical.

Figure 12:
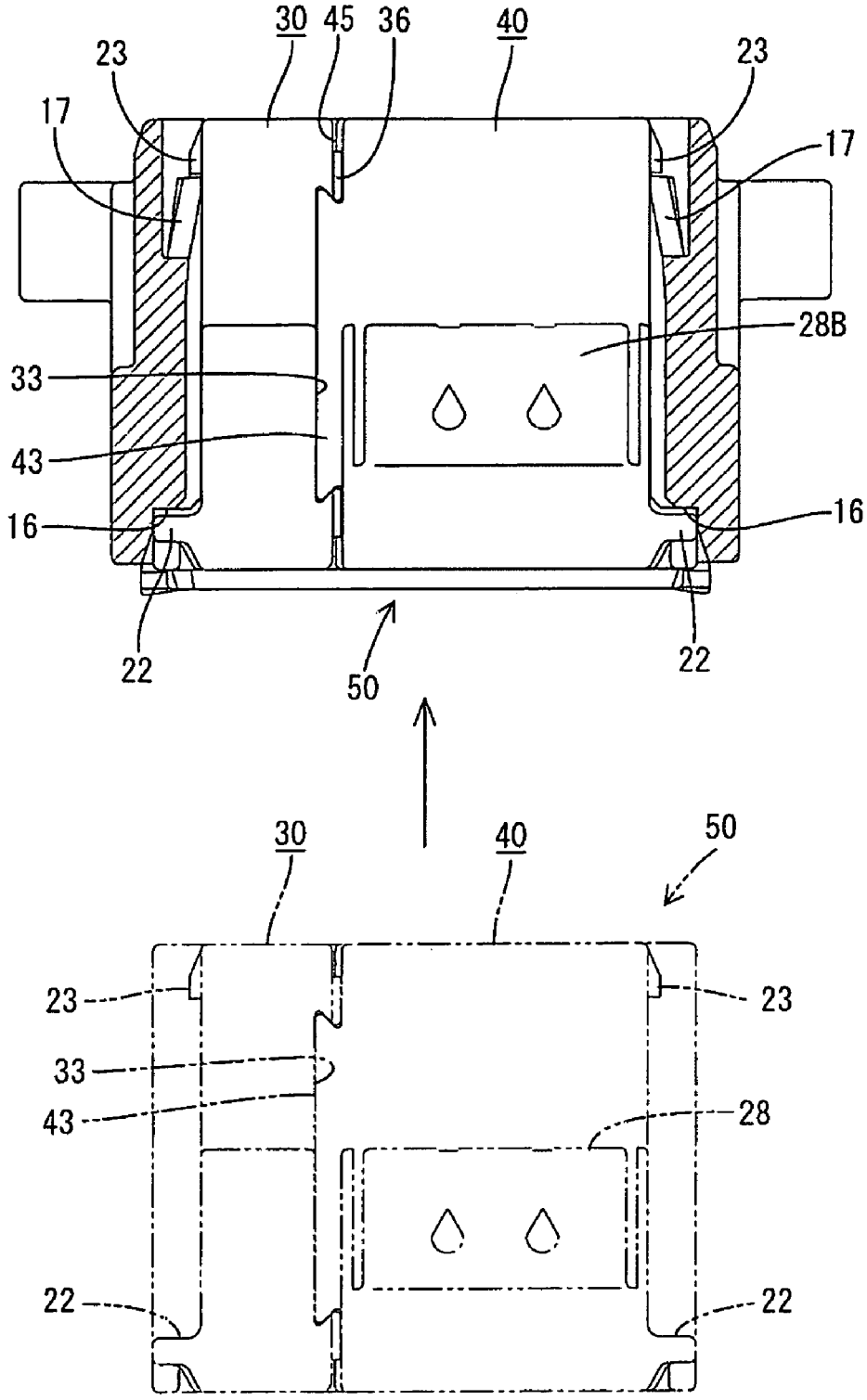
FIG. 12 is a diagram showing an operation of accommodating the united housing.
Figure 13:
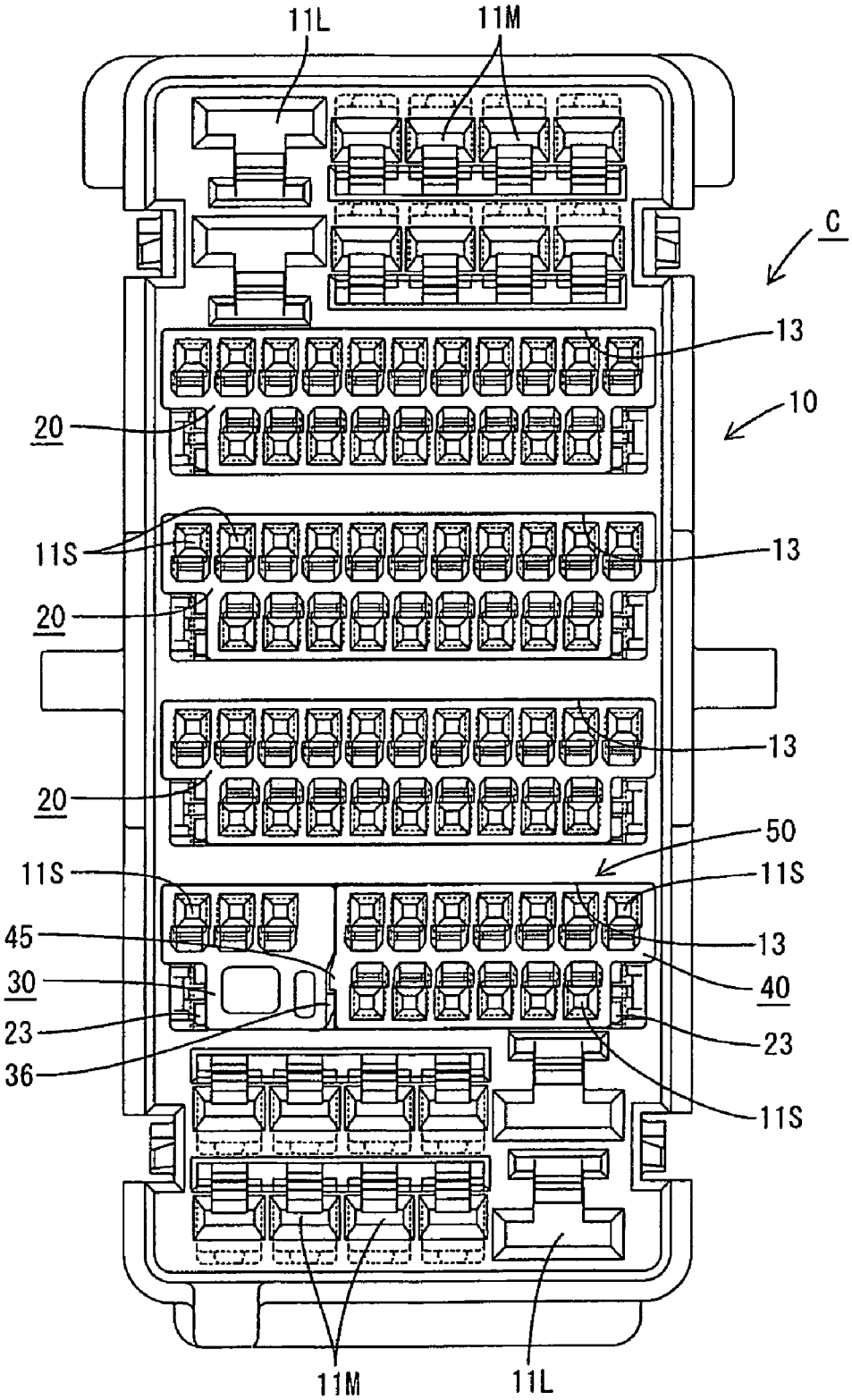
FIG. 13 is a front view of the divided connector accommodating the united housing in one of the auxiliary housings.

The upper and lower resilient holding pieces 28A, 28B are pressed to be closed and the united housing 50 is inserted into the corresponding accommodating chamber 13 from behind and along the inserting direction ID, as shown in FIG. 12. The united housing 50 deforms the locking pieces 17. The locking pieces 17 restore resiliently to engage the locking surfaces 24A when the stopper plates 22 contact the contact surfaces 16 to stop the pushing operation with the united housing 50 retained in the accommodating chamber 13. Similarly, the front surface of the united housing 50 is substantially flush with the front of the accommodating chamber 13 and the rear surface of the united housing 50 projects slightly from the rear of the accommodating chamber 13. Further, the resilient holding pieces 28A, 28B on the top and bottom surfaces are deformed resiliently away from the elevated surfaces 27 and are pressed against the ceiling and bottom surfaces of the accommodating chamber 13 to prevent vertical shaking of the auxiliary housing 20.

Circuits for the divided connector C may be only general circuits. In this case, the small female terminals connected with one or more harnesses of the general circuits are accommodated into the auxiliary housings 20, and the auxiliary housings 20 are accommodated into the corresponding accommodating chambers 13 of the frame, as shown in FIG. 6.

On the other hand, the divided connector C may require a specific circuit, such as an air-bag circuit. In this case, the small female terminals connected with at least one harness of the specific circuit are accommodated in the small housing 30. At the same time, the supplementary housing 40 is prepared and small female terminals connected with at least one harness of a general circuit are accommodated therein. Thereafter, the small housing 30 and the supplementary housing 40 are united to form the united housing 50 and are accommodated in the specified accommodating chamber 13 of the frame 10, as shown in FIG. 13 and as described above. The auxiliary housings 20 with the small female terminals for general circuits are accommodated in the remaining accommodating chambers 13.

Specifically, according to this embodiment, the united housing 50 having an outer configuration substantially common to the auxiliary housings 20 can be formed by uniting the small housing 30 and the supplementary housing 40. Thus, the auxiliary housing 20 and the united housing 50 can be selected for accommodation into the same accommodating chamber 13 of the frame 10. Therefore, a single frame 10 is prepared regardless of whether the small housing 30 is used for the specific circuit. Hence, different arrangements can be dealt with inexpensively and efficient use can be realized in terms of the number of contact positions.

The small housing 30 and the supplementary housing 40 are united by engaging the dovetail groove 33 and the dovetail projection 43 on the connection surfaces 32, 42 and extending along the inserting direction ID and substantially normal to a connecting direction with the mating connector. Thus, the small housing 30 and the supplementary housing 40 are unlikely to be displaced in the connecting direction and the inserting direction ID in which they are subject to loads during the connection with the mating connector. Therefore, the corresponding male and female terminal fittings can be connected precisely to ensure reliable electrical connection.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The arrangement of the dovetail groove and the dovetail projection for connecting the small housing and the supplementary housing in the foregoing embodiment may be reversed. Moreover, the projection and groove can have configurations that are not dovetailed, but interengageable so that a sliding in the mating direction MD is possible while the united housing 50 is being formed, while preventing movement in any direction other than the mating direction MD (e.g. the projection may substantially have a T- or L-shaped cross section or the like while the groove has a mating shape).

The specific circuit for which the small housing is used is not limited to the air-bag circuit mentioned in the foregoing embodiment, and may be an other circuit having a small number of contact positions.

The distribution of the contact positions between the small housing and the supplementary housing is not limited to the one described above.

Two or more united housings may be accommodated in the accommodating chambers.

The auxiliary housings or the united housing may be of the hybrid type and may a plurality of kinds and sizes of terminal fittings.

All of the terminal fittings in the divided connector may have the same size.

It is not necessary for the respective accommodating chambers to have the same size, and it is sufficient to enable the selective accommodation of the auxiliary housing and the united housing for at least one of the accommodating chambers.

The present invention is also applicable to a male connector accommodating male terminals.

What is claimed is:

1. A divided connector, comprising:

a frame with at least one accommodating chamber, the accommodating chamber having an inner configuration;

at least one auxiliary housing having an outer configuration substantially conforming to the inner configuration of the accommodating chamber to accommodate the auxiliary housing in the accommodating chamber of the frame, at least one terminal cavity being formed in the auxiliary housing;

a small housing smaller than the auxiliary housing, and formed with at least one terminal cavity therein; and a supplementary housing smaller that the auxiliary housing and being dimensioned differently than the small housing, the supplementary housing having at least one terminal cavity therein and being unitable substantially side by side with the small housing to define a united assembly having an outer configuration substantially conforming to the outer configuration of the auxiliary housing and substantially conforming to the inner configuration of the accommodating chamber so that a selected one of the auxiliary housing and the united assembly is accommodated in the accommodating chamber of the frame;

wherein the auxiliary housing and the united assembly each comprise at least one elevated surface having at least one resilient holding piece engages the frame to hold one of the auxiliary housing and the united assembly in a proper mounting position.

2. The divided connector of claim 1, wherein the small housing and the supplementary housing are united by engagement of at least one groove and at least one mating projection formed on connection surfaces of the small housing and the supplementary housing.

3. The divided connector of claim 2, wherein the groove and the mating projection extend in a direction substantially normal to an insertion direction of the united assembly into the frame.

4. The divided connector of claim 1, further comprising latching means for latching the housing with the supplementary housing.

5. The divided connector of claim 4, wherein the latching means comprise at least one latch engageable with at least one engaging projection formed near lateral edges of the groove.

6. The divided connector of claim 1, further comprising at least one stopper plate on the auxiliary housing and the united assembly for contacting contact surfaces on the frame to stop a pushing operation of the auxiliary housing or the united assembly into the accommodating chamber.

7. The divided connector of claim 1, wherein the auxiliary housing and the united assembly each comprise at least one holding piece for engaging the frame to hold one of the auxiliary housing and the united assembly in a proper mount position.

8. The divided connector of claim 7, wherein the holding piece is resilient.

9. A divided connector, comprising:

a frame with at least one accommodating chamber;

at least one auxiliary housing having an outer configuration to accommodate the auxiliary housing in the accommodating chamber of the frame;

a small housing smaller than the accommodating chamber; and a supplementary housing unitable substantially side by side with the small housing to define a united assembly having an outer configuration substantially conforming to the outer configuration of the auxiliary housing, the auxiliary housing and the united assembly each comprising at least one elevated surface having at least one resilient holding piece engages the frame to hold one of the auxiliary housing and the united assembly in a proper mount position, wherein the resilient holding piece is resiliently deformable away from the elevated surfaces and against a corresponding surface of the accommodating chamber prevents shaking of the auxiliary housing and united assembly.

10. A divided connector, comprising:

a frame with a plurality of accommodating chambers;

a plurality of auxiliary housings each having an outer configuration to accommodate in one of the accommodating chambers of the frame, each of the auxiliary housings having cavities for receiving terminal fittings;

a small housing smaller than the auxiliary housing and having at least one cavity for receiving a terminal fitting; and a supplementary housing unitable substantially side by side with the small housing to define a united assembly, the supplementary housing being smaller than the auxiliary housing, the united assembly having an outer configuration substantially conforming to the outer configuration of the auxiliary housing so that a selected one of the auxiliary housing and the united assembly is accommodated in one of the accommodating chambers of the frame, wherein the auxiliary housing and the united assembly each comprise at least one holding piece engages the frame to hold one of the auxiliary housing and the united assembly in a proper mount position.

11. The divided connector of claim 10, wherein the supplementary housing has at least one cavity for receiving a terminal fitting.

12. The divided connector of claim 10, wherein the small housing and the supplementary housing are united by engagement of at least one groove and at least one mating projection formed on connection surfaces of the small housing and the supplementary housing.

13. The divided connector of claim 11, wherein the groove and the mating projection extend in a direction substantially normal to an insertion direction of the united assembly into the frame.

14. The divided connector of claim 10, wherein the supplementary housing is dimensioned differently than the small housing.

15. The divided connector of claim 10, wherein the holding piece is resilient.

16. The divided connector of claim 10, wherein the supplementary housing is dimensioned differently than the small housing.

17. The divided connector of claim 16, wherein each of the auxiliary housing, the small housing and the supplementary housing have at least one terminal cavity therein.

18. The divided connector of claim 17, wherein the accommodating chamber has an inner configuration substantially conforming to outer configurations of the auxiliary housing and the united assembly.

* * * * *